United States Patent [19]

Poleschuk et al.

[11] 4,281,229

[45] Jul. 28, 1981

[54] BUZZER SWITCH

[75] Inventors: Nicholas A. Poleschuk, Farmington; Samuel E. Purdy, Ortonville, both of Mich.

[73] Assignee: Beta Manufacturing Corp., Warren, Mich.

[21] Appl. No.: 62,719

[22] Filed: Aug. 1, 1979

[51] Int. Cl.[3] ..... H01H 3/16

[52] U.S. Cl. ..... 200/52 R; 200/61.76; 200/283

[58] Field of Search ..... 200/52 R, 61.62, 303, 200/335, 61.41, 61.42, 61.44, 61.76, 61.78, 61.80, 331, 332, 153 T, 283, 1 A, 1 TK; 29/622

[56] References Cited

U.S. PATENT DOCUMENTS

| | | | |
|---|---|---|---|
| 3,163,741 | 12/1964 | Bury | 200/303 |
| 3,571,541 | 3/1971 | Bedocs et al. | 200/303 |
| 3,694,595 | 9/1972 | Horecky | 200/61.76 |

*Primary Examiner*—Stanley J. Witkowski
*Assistant Examiner*—Morris Ginsburg

[57] ABSTRACT

A buzzer switch comprising a housing of plastic material including a laterally extending slot. A contact made of spring material is positioned in the slot and has a first portion thereof extending in cantilever fashion adjacent the upper end of the body. The body has a second slot therein for receiving a second contact. The second contact has a portion extending in cantilever fashion in generally the same direction as the cantilever portion of the first contact. An actuator is pivoted to the body and has a portion thereof adapted to engage and move the cantilever portion of the first contact inwardly of the body into contact with the second contact. A cover closes the slots in the body. The cover includes openings through which terminals extend into contact with first and second contacts.

14 Claims, 8 Drawing Figures

BUZZER SWITCH

This invention relates to buzzer switches for automotive use.

BACKGROUND AND SUMMARY OF THE INVENTION

In connection with automobiles and the like, it is become common to utilize a buzzer switch which functions to provide a signal to the operator of the automobile under various conditions, for example, when the key is left in the ignition switch or when a door is left open. Inasmuch as such a switch needs to be quite sensitive and yet must be placed in relatively confined areas, a serious problem is provided which necessitates a reliable compact easily assembled switch.

Accordingly, among the objectives of the present invention is to provide a buzzer switch which can be readily manufactured, which is compact and which can be placed in very confined areas.

In accordance with the invention, the buzzer switch comprises a housing of plastic material including a laterally extending slot, a first contact in the slot and having a portion thereof extending in cantilever fashion adjacent the upper end of the body. A second contact is provided in a second slot in the body and has a portion extending in cantilever fashion in generaly the same direction as the cantilever portion of the first contact. An actuator is pivoted to the body and has a portion thereof adapted to engage and move the cantilever portion of the first contact inwardly of the body into contact with the second contact. A cover closes the slots in the body and has openings into which terminals extend into contact with the first and second contacts.

DESCRIPTION

Figure 1:
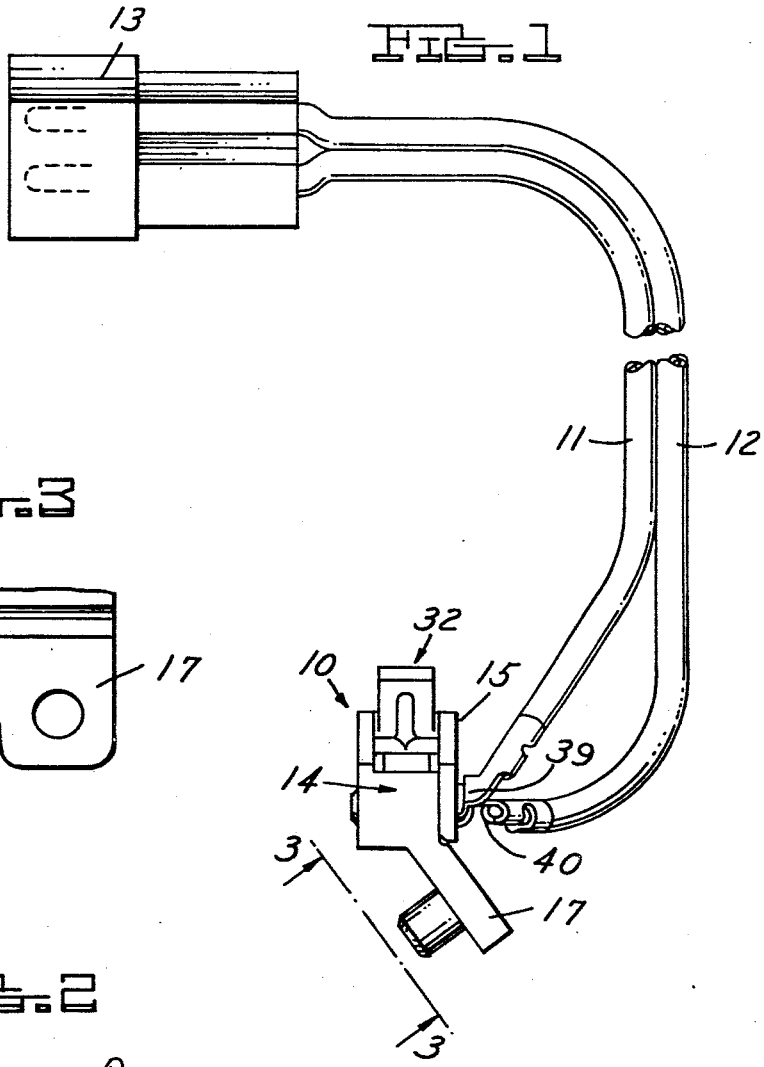
FIG. 1 is a view of a buzzer switch embodying the invention with the electrical harness associated therewith.
Figure 3:
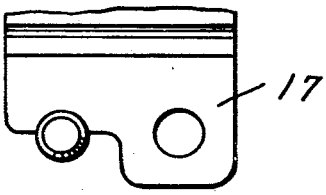
FIG. 3 is a fragmentary view taken along the line 3—3 in FIG. 1.
Figure 2:
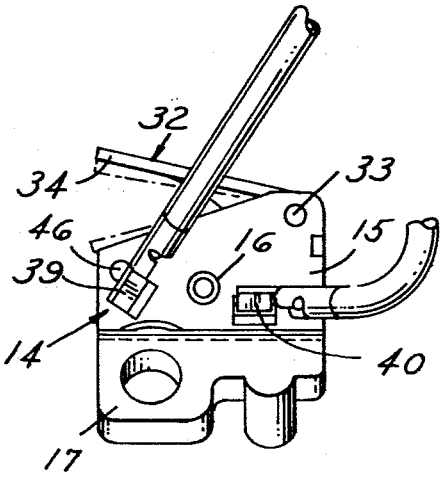
FIG. 2 is a side elevational view.

Referring to FIG. 1, buzzer switch 10 is adapted to be mounted adjacent a device the position of which is to be sensed to produce the electric signal and includes in the final assembly wires or leads 11,12 that extend to an insulated terminal 13, the latter being of conventional construction.

The buzzer switch 10 comprises a body 14 of plastic material and a cover 15 of plastic material held on the body by a rivet 16. The body 14 includes a mounting portion 17 whereby the switch can be mounted in the desired confined area.

The body 14 and cover are preferably made with a plastic material such as nylon which is heat stabilized with glass fibers. An approved material comprises nylon type 66 such as manufactured by Dupont under the trade name Zytel and having the designation 70GHSI-L. On a typical application, body 14 may have a thickness of about one third of an inch, a width of about two thirds of an inch and a height of about one half inch.

Figure 4:
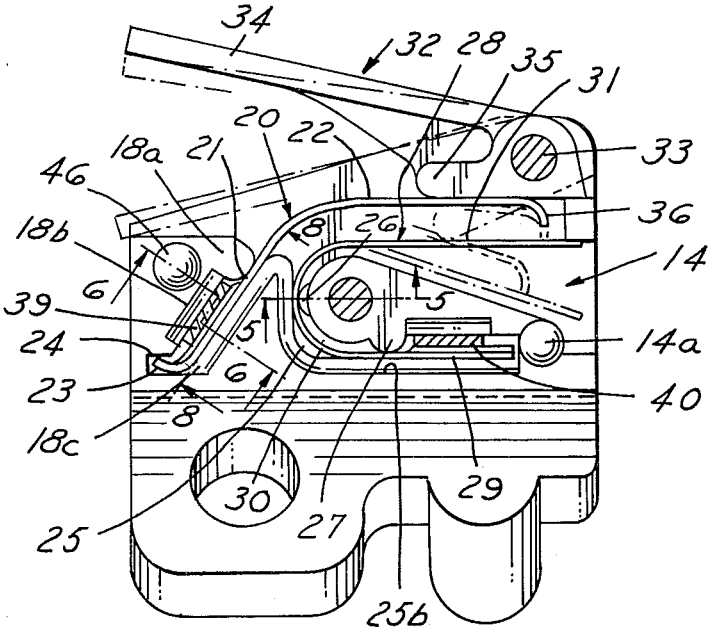
FIG. 4 is a view similar to FIG. 2 on an enlarged scale with the cover removed.
Figure 5:
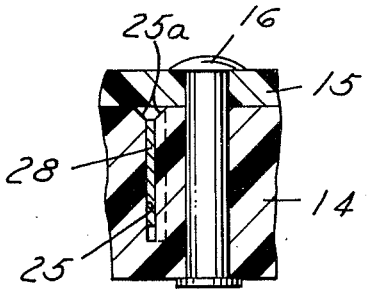
FIG. 5 is a fragmentary sectional view on an enlarged scale taken along the line 5—5 in FIG. 4.
Figure 6:
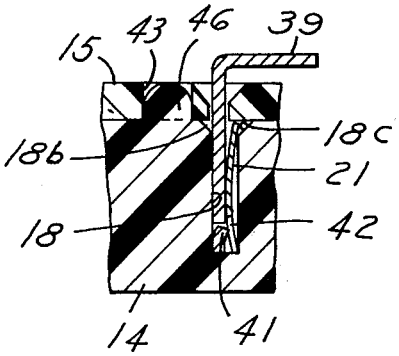
FIG. 6 is a fragmentary sectional view taken along the line 6—6 in FIG. 4.
Figure 7:
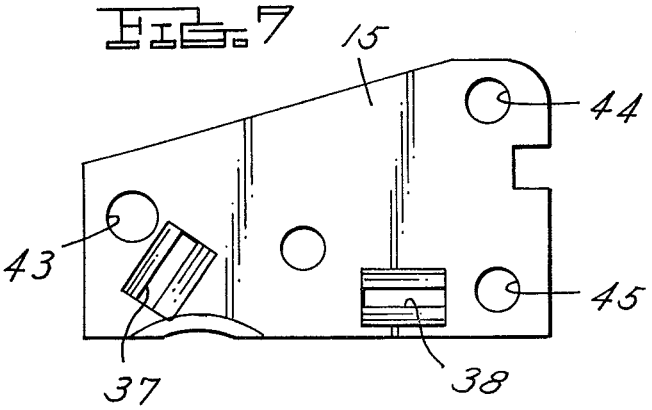
FIG. 7 is a side view of the cover.
Figure 8:
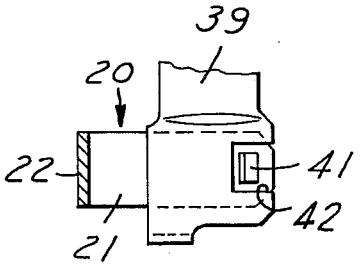
FIG. 8 is a fragmentary view of a contact taken along the line 8—8 in FIG. 4.

As shown in FIGS. 4 and 6 the body 14 includes a first slot 18 that extends upwardly and inwardly as viewed in FIG. 4 and is bowed transversely. A first contact 20 is inserted by lateral movement into the slot 18 so that a first portion 21 of contact 20 engages the slot 18. The first contact 20 includes a second portion 22 that extends generally horizontally in cantilever fashion as viewed in FIG. 4 at an obtuse angle to the first portion 21. The free end 23 of the first portion 21 extends longitudinally into a recess 24 to prevent outward movement of the contact 20 along the axis of the slot 18. Body 14 includes a transverse bead **18*a* at the upper end of slot 18 viewed in FIG. 4 and inclined surface 18*b* extending along the length of the slot along one wall intermediate its ends providing a guide for insertion of a terminal as presently described. A bead 18*c* extends along the other wall of slot 18**.

The body 14 further includes a second slot 25 that is generally L-shaped and is defined by a bead 256 in the body and spaced projections 26,27. A second contact 28 having a first straight portion 29, a curved portion 30, and a second straight portion 31 is provided in the slot 25 with the second portion 31 extending in the same general direction as the portion 22 of the first contact 20 in cantilever fashion. Body 14 includes inclined surfaces **25*a* along a portion of slot 25** to facilitate insertion of a terminal as presently described.

Each of the contacts 20,28 is made of a spring type electrically conducting material such as beryllium copper alloy. A satisfactory material comprises the beryllium copper alloy CA172, temper XHM; having a thickness of $0.008 \pm 0.0008$; and a tensile strength of 160,000 psi minimum.

As actuator 32 is pivoted on an integral post 33 in the body 14 and has a straight cantilever portion 34 extending longitudinally of the body and outwardly as viewed in FIG. 4 and a radial actuator portion 35 engaging the upper end of the portion 22 of first contact 20. When the portion 34 of actuator 32 is pivoted inwardly of the body 14 as shown in broken lines in FIG. 4, the actuator portion 35 swings the portion 22 of contact inwardly in to bring the downwardly bent portion 36 into engagement with the contact portion 31 of the second contact thereby making the electrical contact. Continued movement of the portion 34 inwardly bends the second portion 31 of second contact 28 as shown in broken lines to a final solid position against an integral stop **14*a* on body 14** while maintaining the electrical contact.

When the cover 15 is placed in position, slots 37,38 therein are brought into registry with the slots 18,25. The terminals 39,40 are then inserted through the slots 37,38 bringing the flat portions thereof into engagement with the bowed portions of contact portions 21,29 thereby establishing an electrical connection. In order to prevent movement of the terminals laterally outwardly, a tang 41 is adapted to extend behind a slot 42 on the contact portions 18,29 so that the terminals 39,40 cannot be drawn outwardly through the slots 37,38.

In assembling cover 15 on body 14, holes 43, 44,45 in the cover 15 engage integral pins 46,33 and **14*a***, respectively.

What is claimed is:

1. A buzzer switch comprising a body of plastic material including a laterally extending first slot within said body, a first contact made of electrically conducting spring material, said first contact having a first portion thereof in said first slot and a second portion thereof extending from said first slot in cantilever fashion adjacent the upper end of said body, said body having a second slot within said body, a second contact of electrically conducting spring material capable of flexing the same degree as said first contact, said second contact having a first portion thereof within said second slot and a second portion thereof extending in cantilever fashion in generally the same direction as the cantilever portion of said first contact, a cover closing said body and covering said contacts, an actuator pivoted to said body and having a rotatable portion thereof adapted to rotatably engage and move said cantilever portion of said first contact inwardly of said body into contact with said second contact such that upon initial movement of said actuator by a force on said actuator, the first contact is flexed into engagement with said second contact and continued movement of said actuator causes said first and second contacts to flex while maintaining contact therebetween, and such that when the force on said actuator is removed, the first contact returns to its original position and in turn the actuator returns to its original position and the second contact also returns to its original position.

2. The buzzer switch set forth in claim 1 wherein said cover has first and second openings therein aligned with said first and second slots in said body whereby terminals can be inserted through said openings into said slots.

3. The buzzer switch set forth in claim 2 including an assembly terminal, leads extening from said assembly terminal, and first and second terminals on the ends of said leads, each of said terminals extending through the respective openings in said cover into the respective slots and in frictional engagement with the respective first portions of said first and second contacts.

4. The buzzer switch set forth in claim 3 wherein each said terminal has a tang adjacent the end thereof, each of said first and second contacts having a slot behind which said tang extends when said terminal is in position thereby retaining said terminal against laterally outward movement of said body.

5. The buzzer switch set forth in claim 3 wherein said first contact includes a portion bowed radially outwardly into frictional engagement with its respective terminal.

6. The buzzer switch set forth in claim 1 wherein a free end of said first contact within said body is bent out of the general plane thereof, said first slot having a corresponding portion extending in the direction of said free end of said first contact whereby when said first contact is in position the first contact is retained against movement along said slot out of said body.

7. The buzzer switch set forth in claim 1 wherein a free end portion of said cantilever portion of said first contact is bent radially inwardly and extends toward said second contact.

8. The buzzer switch set forth in claim 1 wherein said second contact includes a portion bowed out of the plane of the first portion thereof.

9. The buzzer switch set forth in claim 1 including a stop on said body for limiting the movement of said cantilever portion of said second contact by said first contact.

10. The buzzer switch set forth in any of claims 1-9 wherein said second portion of said first contact forms an obtuse angle with respect to said first portion of said first contact.

11. The buzzer switch set forth in claim 10 wherein said second contact includes an intermediate curved portion connecting said first and second portions thereof such that said first and second portions extend in the same direction and are generally parallel.

12. The buzzer switch set forth in claim 11 wherein said second slot is defined by an L-shaped surface and a laterally extending pin.

13. The buzzer switch set forth in claim 12 wherein said L-shaped surface has an exposed inclined surface when said cover is removed to facilitate insertion of said second contact.

14. The buzzer switch set forth in claim 13 wherein said pin includes integral projections thereon.

* * * * *